US010370962B2

(12) United States Patent
Zhang et al.

(10) Patent No.: US 10,370,962 B2
(45) Date of Patent: Aug. 6, 2019

(54) SYSTEMS AND METHODS FOR REAL-TIME MONITORING OF A LINE

(71) Applicant: ExxonMobil Research and Engineering Company, Annandale, NJ (US)

(72) Inventors: Yibing Zhang, Annandale, NJ (US); Limin Song, West Windsor, NJ (US); Zhen Li, Houston, TX (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 68 days.

(21) Appl. No.: 15/806,533

(22) Filed: Nov. 8, 2017

(65) Prior Publication Data

US 2018/0163532 A1 Jun. 14, 2018

Related U.S. Application Data

(60) Provisional application No. 62/431,467, filed on Dec. 8, 2016.

(51) Int. Cl.
*E21B 47/14* (2006.01)
*E21B 47/00* (2012.01)

(52) U.S. Cl.
CPC ..... *E21B 47/14* (2013.01); *E21B 47/00* (2013.01); *E21B 47/0001* (2013.01)

(58) Field of Classification Search
CPC ..... E21B 47/14; E21B 47/00; E21B 47/0001
(Continued)

(56) References Cited

U.S. PATENT DOCUMENTS 5,924,499 A 7/1999 Birchak et al.
6,390,733 B1 * 5/2002 Burbage ..... B63B 25/12 114/121

(Continued)

FOREIGN PATENT DOCUMENTS

CN 102385051 A 3/2012
WO 201388157 A1 6/2013
WO 2013154231 A1 10/2013

OTHER PUBLICATIONS

Gauthier et al.,"Mooring Line Monitoring to Reduce Risk of Line Failure", Proceedings of the Twenty-fourth International Offshore and Polar Engineering Conference, 2014, pp. 388-393, vol. 4, International Society of Offshore and Polar Engineers.

(Continued)

*Primary Examiner* — Leon Flores
(74) *Attorney, Agent, or Firm* — Priya G. Prasad; Andrew T. Ward

(57) ABSTRACT

A system for monitoring a line comprising a line, such as a mooring line, umbilical, pipeline, or riser. connected to an offshore structure including a control processor located on the offshore structure, a wireless network comprising a plurality of communication nodes positioned along the line, and a plurality of measurement devices embedded within the communication nodes. When the line is being monitored, the output of each of the measurement devices is in continuous wireless communication with the wireless network via at least one of the communication nodes positioned along the line and the wireless network is in continuous communication with the control processor.

16 Claims, 2 Drawing Sheets

(58) Field of Classification Search
USPC ..... 367/131–134
See application file for complete search history.

(56) References Cited

U.S. PATENT DOCUMENTS

| | | | | |
|---|---|---|---|---|
| 6,670,880 | B1 | 12/2003 | Hall et al. | |
| 6,899,178 | B2 | 5/2005 | Tubel | |
| 6,912,177 | B2 | 6/2005 | Smith | |
| 7,277,026 | B2 | 10/2007 | Hall et al. | |
| 8,242,928 | B2 | 8/2012 | Prammer et al. | |
| 9,759,062 | B2 | 9/2017 | Deffenbaugh et al. | |
| 2007/0223306 | A1* | 9/2007 | Toennessen | G01V 1/3808 367/15 |
| 2009/0095087 | A1* | 4/2009 | Yamano | G01N 29/043 73/622 |
| 2010/0263389 | A1* | 10/2010 | Bryngelson | F16L 37/002 62/50.2 |
| 2013/0279298 | A1 | 10/2013 | Prentice et al. | |
| 2015/0240627 | A1* | 8/2015 | Gao | E21B 47/122 422/82.02 |
| 2015/0292319 | A1 | 10/2015 | Disko et al. | |
| 2015/0330206 | A1* | 11/2015 | Trillon | G01N 17/04 138/103 |
| 2016/0094298 | A1* | 3/2016 | Isfeldt | G01V 1/226 398/104 |

OTHER PUBLICATIONS

Lugsdin, "Real Time 24/7 Integrity Monitoring of Mooring Lines, Risers, and Umbilicals on a FPSO Using 360 Degree Multibeam Sonar Technology", SPE Offshore Europe Conference and Exhibition, 2013, pp. 646-656, SPE International.

Blondeau et al., "Riser Integrity Monitoring for Offshore Fields", Offshore Technology Conference (Asia), OTC-24791-MS Mar. 25, 2014-Mar. 28, 2014, pp. 1-10.

* cited by examiner

SYSTEMS AND METHODS FOR REAL-TIME MONITORING OF A LINE

CROSS-REFERENCE TO RELATED APPLICATIONS

This application claims the benefit of U.S. Provisional Application No. 62/431,467, filed on Dec. 8, 2016, the entire contents of which are incorporated herein by reference.

FIELD

The present disclosure relates to the field of data transmission along a line, such as a pipeline, mooring line, chain, umbilical, riser, etc. The present disclosure further relates to a wireless transmission system for transmitting data to facilitate monitoring integrity of a line in real time, monitor deformation along the line, and monitor stress and corrosion at specific points along the line, among other things.

BACKGROUND

It is desirable to transmit data along a line without the need for wires or radio frequency (electromagnetic) communications devices. Examples abound where the installation of wires is either technically difficult or economically impractical. The use of radio transmission may also be impractical or unavailable in cases where radio-activated blasting is occurring, or where the attenuation of radio waves near the line is significant.

Likewise, it is desirable to collect and transmit data along a line in a wellbore, such as during a drilling process, or in the offshore applications—i.e. mooring lines, risers, etc. Such data may include temperature, pressure, inclination, azimuth, fluid composition, optical images, and localized motion and rotation of the line. These data are used to facilitate monitoring integrity of a line in real time, monitor deformation along the line, and monitor stress and corrosion at specific points along the line, hull cracking, coating degradation, and leakage, among other things.

Currently, such data is collected via a multiplicity of systems and methods with limited detection capabilities. Deployed load sensors can monitor the overall tension, e.g., in a mooring line, but cannot identify damages caused by localized erosion/corrosion, and thus, cannot accurately predict failures. Inclinometers at the surface of the water may not detect failures of a line in real time, especially in catenary mooring systems. Moreover, even though inclinometers can offer a reliable warning of mooring line failure, the conversion of angles into tensions must still be done using estimated lookup tables, resulting in lost accuracy in tension measurements. Sonar/Video mapping can also be used to provide data associated with the health of a line, but such measurements are expensive and are currently done with Remote Operated Vehicles (ROVs)—that is, the data is acquired as needed and cannot provide real-time information, such as information related to the trenching conditions due to the movement of a mooring line close to the sea bottom. Optical fiber based shape sensing systems have been deployed along various lines, but are difficult to implement in offshore applications due to the large deformation and dynamic movements of the lines tend to damage the optical fibers. Strain gauges have been implemented to monitor lines, such as risers, but only monitor the localized conditions and do not monitor the overall health of the line.

Several real time data telemetry systems have also been offered. One involves the use of a physical cable such as an electrical conductor or a fiber optic cable that is secured to the line. The cable may be secured to either the inner or the outer diameter of the pipe. The cable provides a hard wire connection that allows for real-time transmission of data and the immediate evaluation of subsurface conditions. Further, these cables allow for high data transmission rates and the delivery of electrical power directly to downhole sensors.

The use of acoustic telemetry has also been suggested. Acoustic telemetry employs an acoustic signal generated at or near the bottom of the line. The signal is transmitted through a wellbore pipe or water, meaning that the pipe or water becomes the carrier medium for sound waves. Transmitted sound waves are detected by a receiver and converted to electrical signals for analysis.

U.S. Pat. No. 5,924,499 entitled "Acoustic Data Link and Formation Property Sensor for Downhole MWD System" teaches the use of acoustic signals for "short hopping" a component along a drill string. Signals are transmitted from the drill bit or from a near-bit sub and across the mud motors. This may be done by sending separate acoustic signals simultaneously—one that is sent through the drill string, a second that is sent through the drilling mud, and optionally, a third that is sent through the formation. These signals are then processed to extract readable signals.

U.S. Pat. No. 6,912,177, entitled "Transmission of Data in Boreholes," addresses the use of an acoustic transmitter that is part of a downhole tool. Here, the transmitter is provided adjacent a downhole obstruction such as a shut-in valve along a drill stem so that an electrical signal may be sent across the drill stem. U.S. Pat. No. 6,899,178, entitled "Method and System for Wireless Communications for Downhole Applications," describes the use of a "wireless tool transceiver" that utilizes acoustic signaling. Here, an acoustic transceiver is in a dedicated line that is integral with a gauge and/or sensor. This is described as part of a well completion.

Faster data transmission rates with some level of clarity have been accomplished using electromagnetic (EM) telemetry. EM telemetry employs electromagnetic waves, or alternating current magnetic fields, to "jump" across pipe joints. In practice, a specially-milled drill pipe is provided that has a conductor wire machined along an inner diameter. The conductor wire transmits signals to an induction coil at the end of the pipe. The induction coil, in turn, then transmits an EM signal to another induction coil, which sends that signal through the conductor wire in the next pipe. Thus, each threaded connection provides a pair of specially milled pipe ends for EM communication.

National Oilwell Varco® of Houston, Tex. offers a drill pipe network, referred to as IntelliServ®, that uses EM telemetry. The IntelliServ® system employs drill pipe having integral wires that can transmit LWD/MWD data to the surface at speeds of up to 1 Mbps. This creates a communications system from the drill string itself. The IntelliServ® communications system uses an induction coil built into both the threaded box and pin ends of each drill pipe so that data may be transmitted across each connection. Examples of IntelliServe® patents are U.S. Pat. No. 7,277,026 entitled "Downhole Component With Multiple Transmission Elements," and U.S. Pat. No. 6,670,880 entitled "Downhole Data Transmission System."

It is observed that the induction coils in an EM telemetry system must be precisely located in the box and pin ends of the joints of the drill string to ensure reliable data transfer. For a long (e.g., 20,000 foot) well, there can be more than 600 tool joints. The represents over 600 pipe sections to be threadedly connected. Further, each threaded connection is preferably tested at the drilling platform to ensure proper functioning.

National Oilwell Varco° promotes its IntelliServe® system as providing the oil and gas industry's "only high-speed, high-volume, high-definition, bi-directional broadband data transmission system that enables downhole conditions to be measured, evaluated, monitored and actuated in real time." However, the IntelliServe® system generally requires the use of booster assemblies along the drill string. These can be three to six foot sub joints having a diameter greater than the drill pipe placed in the drill string. The booster assemblies, referred to sometimes as "signal repeaters," are located along the drill pipe about every 1,500 feet. The need for repeaters coupled with the need for specially-milled pipe can make the IntelliServe® system a very expensive option.

Recently, the use of radiofrequency signals has been suggested. This is offered in U.S. Pat. No. 8,242,928 entitled "Reliable Downhole Data Transmission System." This patent suggests the use of electrodes placed in the pin and box ends of pipe joints. The electrodes are tuned to receive RF signals that are transmitted along the pipe joints having a conductor material placed there along, with the conductor material being protected by a special insulative coating.

While high data transmission rates can be accomplished using RF signals in a downhole environment, the transmission range is typically limited to a few meters. This, in turn, requires the use of numerous repeaters.

Chinese Pat. No. CN102385051 entitled "Device and Method for Monitoring Mooring System Based on Short Base Line Hydro-Acoustic Positioning" describes a direct acoustic positioning system. Multiple acoustic signal interrogators and transponders are positioned at the bottom of a floating platform, seabed, and along an anchor chain. The monitoring system performs real-time online measuring and monitoring of the shape of a mooring line, but relies solely on ultrasonic wave propagation under water, which diminishes its accuracy.

WO App. No. 2013/154231 entitled "Method and System for Static and Dynamic Positioning of Marine Structure by Using Real-Time Monitoring of Mooring Line" describes the use of optical fibers to monitor the strain of the various mooring lines attached to the marine structure and converts the strain measurements into an approximation of location of the marine structure. As described above, optical fibers can be easily damaged based on large deformations that can occure in mooring lines.

Addtionally, several articles have been written regarding mooring line integrity as well as riser monitoring. Steven et al., in *Mooring Line Monitoring to Reduce Risk of Line Failure,* describes a system using inclinometers to measure the mooring system condition and inform on the effective loading of each anchor leg. Proceedings of the International Offshore and Polar Engineering Conference, 388-93 (2014). The system determines average line tension using estimated lookup tables based on data transmitted acoustically to a surface control room. Angus, in *Real Time* 24/7 Integrity Monitoring of Mooring Lines, Risers, and Umbilicals on a FPSO Using 360 *Degree Multibeam Sonar Technology,* invokes multibeam sonar scanning to monitor the bend of the mooring line. SPE Offshore Europe Conference and Exhibition, 646-56 (2013). This is not a direct measurement of the mooring line and can be affected by environmental conditions. Blondeau et al., in *Riser Integrity Monitoring for Offshore Fields,* describes a vibrating wire gauge utilized as a strain gauge to monitor the integrity of risers and riser towers. Offshore Technology Conference (Asia) (Mar. 25, 2014-Mar. 28, 2014).

Accordingly, a need exists for a low cost, low maintenance, reliable system and method for monitoring lines. The present disclosure provides a monitoring system utilizing an ultrasonic wireless communication network and various sensors to assess the overall heath of the line. All measurement devices are embedded within the sensors and data fusion techniques can be used to develop an overall health assessment of the line.

SUMMARY

Systems and methods for monitoring a line are provided herein. While the below summary primarily describes a system, it would be well understood to a person of skill in the art that the description is equally applicable to methods using the system. In one embodiment, the system comprises a line connected to an offshore structure; wherein the offshore structure includes a control processor; a wireless network, such as an ultrasonic wireless network, comprising a plurality of communication nodes positioned along the line; a plurality of measurement devices positioned along the line; wherein the measurement devices are embedded within the communication nodes; wherein, when the line is being monitored, the output of each of the measurement devices is in continuous wireless communication with the wireless network via at least one of the communication nodes positioned along the line; wherein, when the line is being monitored, the wireless network is in continuous communication with the control processor located on the offshore structure.

The line itself can be tubular—i.e. having a void space on the interior of the line—or solid. In one aspect, the line is one of a mooring line, umbilical, pipeline, and riser. In other aspects, the measurement devices can include at least one of a temperature gauge, a pressure gauge,a strain gauge, a 3D accelerometer, a 3D gyroscope, a video camera, acoustic emission testing, or combinations thereof.

In yet another aspect, a given communication node can be paired with its closest neighbor such that the node can communicate data from its measurement devices to a neighboring node, which can be in turn transmitted to the next neighboring node and so on up to the control processor, where data fusion techniques can provide comprehensive indication of early warning of failure, deformation, crack formation or propagation, and/or deterioration of trenching conditions, etc. The communication node may also be paired with other communication nodes along the line within the range of the node, typically about 1000 meters. In one embodiment, the nodes can be placed about 500-1000 meters apart on the line. The top communication node can be connected to the control processor via wired, RF wireless, ultrasonic wireless, or acoustic wireless communication.

Data fusion technology provides correlation among all sensor measurements. Both spatial and temporal measurement results are used to determine an overall health assessment of the line. As a result, data fusion not only provides smoothly interpolated results from measured positions, but also improves tolerance for sensor failures. In the data fusion method, hydrodynamic models of the mooring lines can also be developed to account for dynamic behavior of the various sections of the mooring line with known physical properties, such as weight, drag, buoyance, etc. Overall, multiple sensors and data fusion methods are used to improve both static and dynamic shape measurement accuracy. In certain embodiments the system also includes an actuator, such as a motor to perform a control function, such as opening or shutting a valve.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION

The subject matter described herein is in connection with certain specific embodiments. However, to the extent that the following detailed description is specific to a particular embodiment or a particular use, such is intended to be illustrative only and is not to be construed as limiting the scope of the disclosure.

Figure 1:
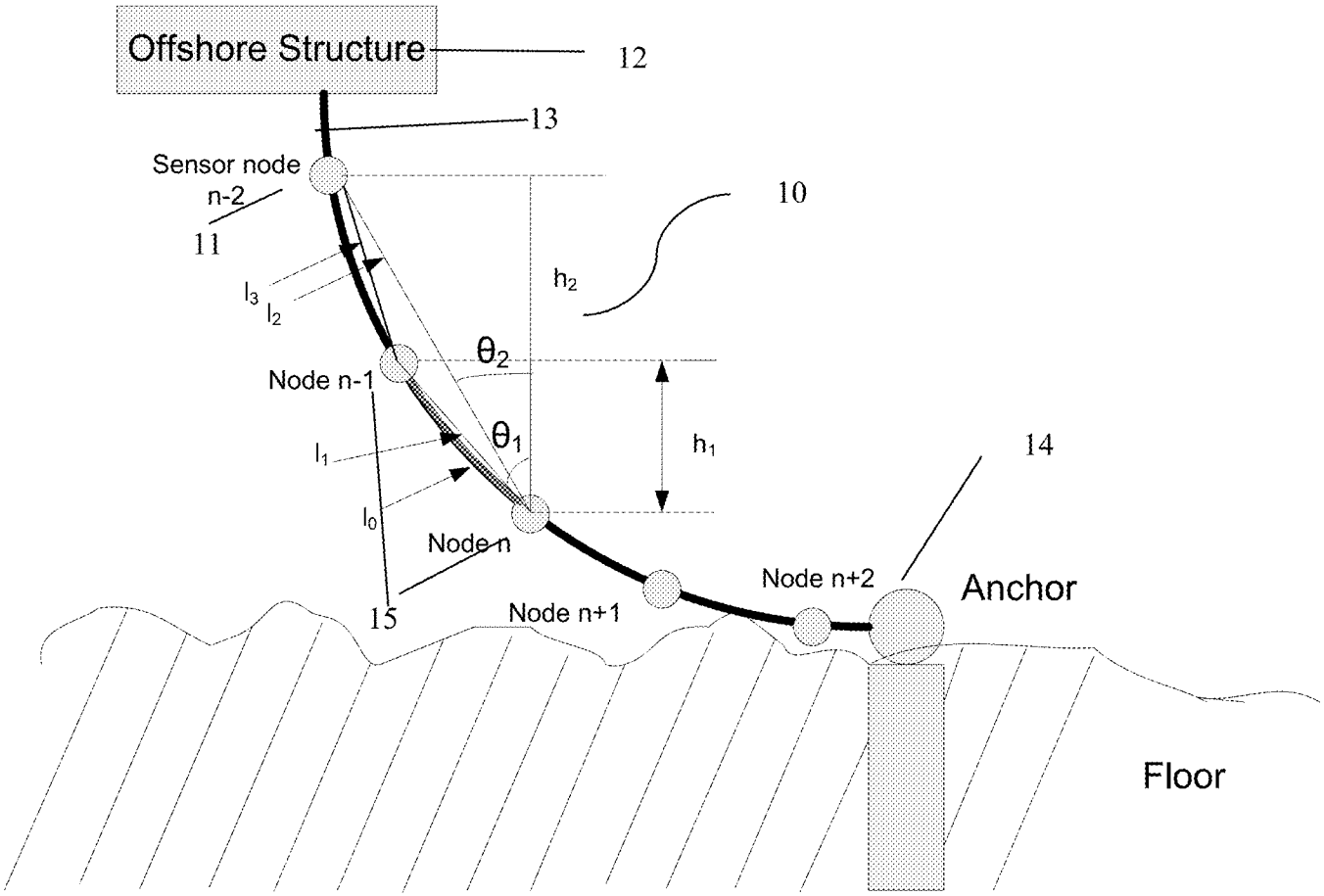
FIG. 1 is a side view of a mooring line between a floating structure and an anchor equipped with an embodiment of the communication system disclosed herein.

FIG. 1 is a side view of an illustrative mooring line and monitoring system 10 (referred to hereinafter as "the system 10"). Although the present disclosure provides a description of a system directed to mooring lines, it will be apparent to a person of skill in the art that the system would be applicable in other line applications such as pipelines, umbilicals, risers, and the like. The system 10 includes a offshore structure 12, which may be a mobile offshore drilling unit (MODU), drillship, semi-submersible rig, jack-up rig, drilling barge, or any other offshore floating platform. Mooring line 13 connects to offshore structure 12 to anchor 14, thereby keeping offshore structure 12 relatively stationary in the water. Multiple mooring lines are installed for offshore structures. Along mooring line 13 are several sensing nodes 15. The top sensing node 11 is connected to a control room (not shown) on offshore structure 12 via wired, radio frequency, or acoustic wireless communication.

In operation, individual sensing nodes 15 are attached to mooring line 13 a pre-selected location. Each sensing node 15 is paired with at least one other sensing node 15 to build communication channel through the water. Each sensing node 15 can be paired with their closest neighbors and/or any other sensing node 15 that are within the requisite communication distance for a reliable communication network, such as between 1-50 meters, e.g. 5-20 meters or 10-30 meters, or as far as 500-1000 meters. This feature not only allows quick re-establishment of communication in case of any single node failure, but also provides abundant measurements to ensure shape measurement accuracy. The acoustic wave frequencies can be unique between each paired sensing nodes, or the same frequency signals sent at different times, to avoid interference among all communication channels. The distance between each sensing node 15 can be predetermined along the mooring line 13 at deployment or determined using time-of-flight of the acoustic waves during the life time of the mooring line 13.

Figure 3:
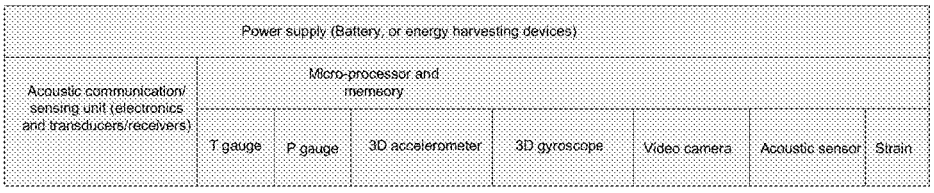
FIG. 3 is a tabular depiction of a sensing node in accordance with one embodiment of the present disclosure.

FIG. 3 describes the features of a typical sensing node 15. First, each sensing node 15 is equipped with a power supply, which can be a battery or some other energy harvesting device. Second, each sensing node 15 is equipped with the ability to communicate acoustically with other sensing nodes. Put another way, each sensing node 15 has a transceiver to both send and receive ultrasonic signals for wireless communications. Third, each sensing node 15 has at least one processor and memory for interpretation of data received from different measurement devices embedded within sensing node 15. Finally, each sensing node 15 has at least one measurement device. Example measurement devices include miniaturized and marginised temperature gauges, pressure gauges, strain gauges, movement sensors such as 3D accelerometers and/or 3D gyroscopes, video cameras, acoustic emission testing (AET) etc. In a preferred embodiment, each sensing node 15 includes a power supply, transceiver, processor, temperature gauge, pressure gauge, strain sensor, 3D accelerometer, 3D gyroscope, AET, and a video camera.

As discussed, a temperature gauge, pressure gauge, 3D accelerometer, 3D gyroscopes, AET, and camera can be integrated together within each sensing node 15. Position and localized deformation measurements can be communicated among each paired nodes and then relayed to the surface of the water. That sensing data can be used to monitor real time motion of the mooring line by data fusion of acceleration, angular velocity, strain and position. Specifically, temperature and pressure gauges at each sensing node 15 are used to compensate the localized sound speed variations with temperatures. Pressure gauges is also used to determine the depth info for each sensing node 15, which can be used directly as a tension and shape indicator. Combining the depth of the sensing node 15 and separation distances from other sensing nodes 15 can be used, the shape of the mooring line can be inferred using the location of each node through a mathematical model (e.g. $\theta_1$, $\theta_2$ as shown in the FIG. 1). 3D accelerometers can be used to monitor the localized motion of the mooring line. 3D gyroscopes can be used to monitor localized rotation of the mooring line. Cameras can be used to monitor surrounding environments, e.g. trenching condition close to the anchor and biological growth along the mooring line, or direct observation of the deformation of the line. AET monitors dynamic processes, i.e. changes, in a material such as crack formation or growth on a line, such as a riser or pipeline.

Figure 2:
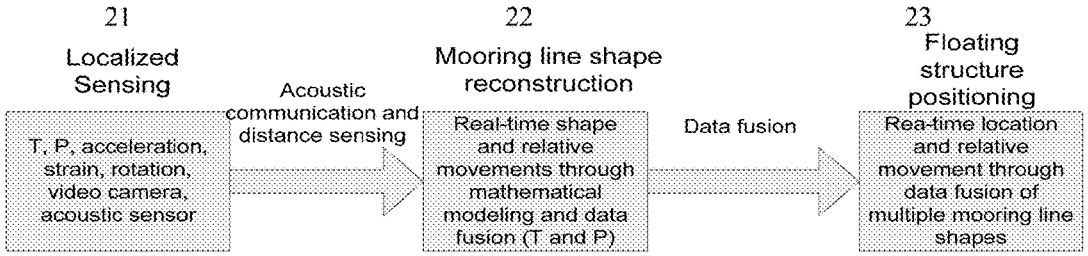
FIG. 2 depicts a flow diagram of a method associated with use of the communication system disclosed herein.

FIG. 2 depicts a flow diagram of a method associated with use of the communication system disclosed herein. At initial step 21 a sensing unit 15 measures one or more of temperature, pressure, strain, acceleration, rotation, acoustics and visual data. Sensing unit 15 then communicates the data received with proximate other sensing units, which is in turn communicated via top sensing node 11 to a control room for information processing in step 22, including using temperatures and pressures to compensate localized speeds of sound and pressures to measure depth of each sensing node. Also in step 22, sensing unit 15 determines its straight line distance from the other sensing units with which it is communicating using the time-of-flight of the acoustic signals and catenary shape approximation to reconstruct the shape of mooring line 13 for the section between the two communicating sensing units. All of this data is then conglomerated using data fusion techniques in step 23, e.g. a Kalman filter, to provide and integrated picture of (1) mooring line integrity, (2) trenching condition near the anchor if applicable, (3) local and overall deformation along each mooring line, (4) and precisely locate offshore structure 13.

Specifically, the various real-time monitoring capabilities mentioned above are achieved using a line position tracking method, which is based on shape sensing technology together with a known point location on the line, i.e. fixed anchor at the bottom of water and/or a top location at the surface. As an example, a single mooring line normally consists of several different sections, including chain, fiber rope, wire rope and various types of connectors. The shape of the mooring lines are dynamic, and are influenced by oceanic current and the offshore structure 12, which may be a mobile offshore drilling unit (MODU), drillship, semi-submersible rig, jack-up rig, drilling barge, or any other offshore floating platform. Full line position tracking using the wireless sensor network along the line not only enables monitoring of individual line integrity, but also assist determination of the position of the offshore structure, once the top positions of all mooring lines are determined.

Shape sensing of the mooring line is the key to track full line position from the top position at the surface to the anchor at the bottom of the water. The shape of a mooring line, ideally, can be determined using the positions of all the points along the line. In specific embodiments, a highly dense sensor array is used, since all sensor nodes are close to each other along the mooring line, the shape of mooring line between each pair of sensor nodes can be approximated as a straight line ($l_0=l_1$ in FIG. 1), and their original separation distance ($l_0$) are known when those sensor nodes are installed, these values are saved in a processor as a baseline. During the operation, the distance ($l_1$) between each sensor nodes can be determined using the time-of-flight of the acoustic signals. Combing the distance ($l_1$) and the depth ($h_1$) from the pressure gauge in each sensor node, angle $\theta_1$ can be calculated and used to infer the localized shape of the mooring line. Once the deviation of the distance ($\Delta l=l_1-l_0$) or angle ($\Delta\theta=\theta_1-\theta_0$) from the baseline reaches a pre-defined threshold value, it can be used as an indicator of early warning of failure, deformation, and/or deterioration of trenching conditions, etc. Due to the various weights, drag and buoyance in different sections of the mooring line, angle $\theta_1$ and $\theta_2$ are different, the pressure gauges therefore offer direct measurements for localized shape. The relative position of nodes (e.g. n, n-1 and n-2) can be triangulated using $l_1$, $l_2$ and $l_3$, and the overall shape of the mooring line can then be determined using this triangulation method on neighboring nodes. Through wireless acoustic communications among the sensor nodes, the relative separation distances between nodes are relayed to the top node and control room for shape construction for real time monitoring.

Limited by costs and complexity, in practice, the number of sensor nodes needs to be reduced. With fewer sensor nodes, their separations ($l_1$, $l_2$ and $l_3$) are determined using the time-of-flight of the acoustic wave, and they are different from the original separation distances (e.g. $l_0 \neq l_1$ in FIG. 1). In this case, angle, e.g. $\theta_1$, can be calculated and used to infer the localized shape of the mooring line, by combing the distance (e.g. $l_1$), and the depth (e.g. $h_1$) from the pressure gauge in each sensor node. In theory, a set of data l, h, and $\theta$ from all sensor nodes is sufficient to determine the overall shape of the mooring line using the triganulation method. Because l, h, and $\theta$ are measured in real time and communicated to the top node and control room for shape construction, any deviations of the relative distances and angles between paired nodes from the baseline can be used as an indicator of early warning of failure, deformation, and/or deterioration of trenching conditions, etc.

Multiple sensors and data fusion methods are used to improve both static and dynamic shape measurement accuracy. It is well known that acoustic ray do not follow straight lines, especially for a long distance, due to depth-dependence of ocean sound-speed profile and temperature. There are existing technologies using the time-of-flight of the acoustic wave to determine shape through inversion algorithms, such as towed-array shape estimation, these technologies use only the time-of-flight of the acoustic wave and optimization algorithms to detect the shape. The method described herein uses multiple sensor measurements and data fusion technology together to improve accuracy and reliability, i.e. temperature and pressure gauges at each sensing node are used to compensate the localized sound speed variations; pressure gauges also measure the depth for each sensing node; strain sensors directly measure local tension and shape. Combining the depth of the sensing node and separation distance from other sensing nodes, the shape of the mooring line can be determined using the triangulation method. To enhance dynamic shape monitoring capability, 3D accelerometers can be used to monitor the localized motion of the mooring line. 3D gyroscopes can be used to monitor localized rotation of the mooring line. Cameras can be used to monitor surrounding environments, e.g. trenching condition close to the anchor and biological growth along the mooring line, or direct observation of the deformation of the line. AET can detect the formation or propagation of a crack in the line. All measurement results from these sensor nodes will be collected and communicated to the top node and control room for signal processing to determine mooring line deformation or integrity in real time.

Data fusion technology provides correlation among all sensor measurements. Both spatial and temporal measurement results are used to determine the shape for accuracy improvements, for example, temperatures and pressures are used to calibrate localized speeds of sound, thus the calculated separation distances are more accurate; also the geometrical constrains are considered, as shown in FIG. 1, $l_1$ should be less or equal to $l_0$, and should also be larger or equal to h. All dynamic changes of the shape are compared with measurement results from other sensors, such as accelerometers, gyroscopes and cameras. As a result, data fusion not only provides smoothly interpolated results from measured positions, but also improves tolerance for sensor failures. In the data fusion method, hydrodynamic models of the mooring lines can also be developed to account for dynamic behavior of the various sections of the mooring line with known physical properties, such as weight, drag, buoyance, etc.

In another aspect system, a display is provided in communication with the control processor. The data fusion technology described in detail above provides for a real-time visual representation of the line to be displayed on the display. Using this system, an operator can visually see the real time shape of the line and any deformations related to excess strain or failure will be readily apparent. Moreover, the operator will be able to precisely locate the offshore structure by using the shape information from all the mooring lines/risers. Once the positions of all mooring lines connected to the offshore structure are determined, the offshore structure's position is known The system may also include an actuator(s), such as a valve(s), along the line. The actuator can be in communication with the wireless network acoustically and can perform a control function, such as opening or closing a valve, based on inputs received from the wireless network.

Additional Embodiments

Embodiment 1. A system for monitoring a line, comprising: a line connected to an offshore structure; wherein the offshore structure includes a control processor; a wireless network comprising a plurality of communication nodes positioned along the line; a plurality of measurement devices positioned along the line; wherein the measurement devices are embedded within the communication nodes; wherein, when the line is being monitored, the output of each of the measurement devices is in continuous wireless communication with the wireless network via at least one of the communication nodes positioned along the line; wherein, when the line is being monitored, the wireless network is in continuous communication with the control processor located on the offshore structure.

Embodiment 2. The system of embodiment 1, wherein the line is one of a mooring line, umbilical, pipeline, and riser.

Embodiment 3. The system of any of the previous embodiments, wherein the wireless network is an ultrasonic wireless network.

Embodiment 4. The system of any of the previous embodiments, wherein each measurement device comprises at least one of a temperature gauge, a pressure gauge,a strain gauge, a 3D accelerometer, a 3D gyroscope, a video camera, acoustic emission testing, or combinations thereof.

Embodiment 5. The system of any of the previous embodiments, wherein each communication node is paired with its closest neighbor.

Embodiment 6. The system of any of the previous embodiments, wherein each communication node is paired with any communication node within 1000 meters as measured by length of the line.

Embodiment 7. The system of any of the previous embodiments, wherein each communication node is spaced at a distance on the mooring line 500-1000 meters.

Embodiment 8. The system of any of the previous embodiments, wherein the top communication node is connected to the control processor via wired, RF wireless, ultrasonic wireless, or acoustic wireless communication.

Embodiment 9. The system of any of the previous embodiments, further comprising an actuator in communication with the wireless network, the actuator designed to perform a control function on the line.

Embodiment 10. The system of embodiment 9, wherein the control function is opening or closing a valve.

Embodiment 11. A method for monitoring a line, comprising: providing a line connected to an offshore structure; wherein the offshore structure includes a control processor; providing a wireless network comprising a plurality of communication nodes positioned along the line; providing a plurality of measurement devices positioned along the line; wherein the measurement devices are embedded within the communication nodes; wherein, when the line is being monitored, the output of each of the measurement devices is in continuous wireless communication with the wireless network via at least one of the communication nodes positioned along the line; monitoring the line via the wireless network which is in continuous communication with the control processor located on the offshore structure.

Embodiment 12. The method of embodiment 11, wherein the line is one of a mooring line, umbilical, pipeline, and riser.

Embodiment 13. The method of any of embodiments 11-12, wherein the wireless network is an ultrasonic wireless network.

Embodiment 14. The method of embodiment 13, wherein each measurement device comprises at least one of a temperature gauge, a pressure gauge, a strain gauge, a 3D accelerometer, a 3D gyroscope, a video camera, acoustic emission testing, or combinations thereof.

Embodiment 15. The method of embodiment 14, wherein each measurement device comprises at least a temperature gauge, a pressure gauge, a strain gauge, a 3D accelerometer, a 3D gyroscope, and a video camera; wherein monitoring the line via the wireless network includes displaying a real-time visual representation of the shape of the line on a display in communication with the control processor.

Embodiment 16. The method of any of embodiments 11-15, wherein each communication node is paired with its closest neighbor.

Embodiment 17. The method of any of embodiments 11-16, wherein each communication node is paired with any communication node within 1000 meters as measured by length of the line.

Embodiment 18. The system of any of embodiments 11-17, wherein each communication node is spaced at a distance on the mooring line as short as several meters up to between 500-1000 meters.

Embodiment 19. The system of any of embodiments 11-18, wherein the top communication node is connected to the control processor via wired, RF wireless, ultrasonic wireless, or acoustic wireless communication.

Embodiment 20. The method of any of embodiments 14-19, wherein each measurement device comprises at least a temperature gauge, a pressure gauge, a strain gauge, a 3D accelerometer, a 3D gyroscope, and a video camera; wherein monitoring the line via the wireless network includes displaying a real-time location of the offshore structure on a display in communication with the control processor.

Embodiment 21. The method of any of embodiments 15-20, wherein the monintoring the line via the wireless network further includes monitoring deformation of the line, stress on the line, or corrosion at a specific point on the line.

While it will be apparent that the inventions herein described are well calculated to achieve the benefits and advantages set forth above, it will be appreciated that the inventions are susceptible to modification, variation and change without departing from the spirit thereof.

The invention claimed is:

1. A system for monitoring a line, comprising:

a line connected to an offshore structure; wherein the offshore structure includes a control processor;

a wireless network comprising a plurality of communication nodes positioned along the line;

a plurality of measurement devices positioned along the line; wherein the measurement devices are embedded within the communication nodes; wherein, when the line is being monitored, the output of each of the measurement devices is in continuous wireless communication with the wireless network via at least one of the communication nodes positioned along the line;

wherein, when the line is being monitored, the wireless network is in continuous communication with the control processor located on the offshore structure;

wherein the wireless network is an ultrasonic wireless network:

wherein each measurement device comprises at least one of a temperature gauge, a pressure gauge, a strain gauge, a 3D accelerometer, a 3D gyroscope, a video camera. an acoustic emission testing, or combinations thereof; and wherein monitoring the line via the wireless network includes displaying a real-time visual representation of the shape of the line on a display in communication with the control processor.

2. The system of claim 1, wherein the line is one of a mooring line, umbilical, pipeline, and riser.

3. The system of claim 2, wherein each communication node is spaced at a distance on the mooring line between 500-1000 meters.

4. The system of claim 1, wherein each communication node is paired with its closest neighbor.

5. The system of claim 4, wherein each communication node is paired with any communication node within 1000 meters as measured by length of the line.

6. The system of claim 1, wherein the communication node comprises a top communication node that is connected to the control processor via wired, RF wireless, ultrasonic wireless, or acoustic wireless communication.

7. The system of claim 1, further comprising an actuator in communication with the wireless network, the actuator designed to perform a control function on the line.

8. The system of claim 7, wherein the control function is opening or closing a valve.

9. A method for monitoring a line, comprising:

providing a line connected to an offshore structure; wherein the offshore structure includes a control processor;

providing a wireless network comprising a plurality of communication nodes positioned along the line;

providing a plurality of measurement devices positioned along the line; wherein the measurement devices are embedded within the communication nodes; wherein, when the line is being monitored, the output of each of the measurement devices is in continuous wireless communication with the wireless network via at least one of the communication nodes positioned along the line;

monitoring the line via the wireless network which is in continuous communication with the control processor located on the offshore structure;

wherein the wireless network is an ultrasonic wireless network;

wherein each measurement device comprises at least one of a temperature gauge, a pressure gauge, a strain gauge, 3D accelerometer, a 3D gyroscope, a video camera, an acoustic emission testing, or combinations thereof; and wherein monitoring the line via the wireless network includes displaying a real-time visual representation of the shape of the line on a display in communication with the control processor.

10. The method of claim 9, wherein the line is one of a mooring line, umbilical, pipeline, and riser.

11. The system of claim 10, wherein each communication node is spaced at a distance on the mooring line between 500-1000 meters.

12. The method of claim 9, wherein each communication node is paired with its closest neighbor.

13. The method of claim 9, wherein each communication node is paired with any communication node within 1000 meters as measured by length of the line.

14. The system of claim 9, wherein the communication node comprises a top communication node that is connected to the control processor via wired, RF wireless, ultrasonic wireless, or acoustic wireless communication.

15. The method of claim 9, wherein monitoring the line via the wireless network includes displaying a real-time location of the offshore structure on a display in communication with the control processor.

16. The method of claim 9, wherein the monitoring the line via the wireless network further includes monitoring deformation of the line, stress on the line, or corrosion at a specific point on the line.

* * * * *